US012595600B2

(12) United States Patent
Ota et al.

(10) Patent No.: US 12,595,600 B2
(45) Date of Patent: Apr. 7, 2026

(54) METHOD OF KNITTING WARP KNITTED FABRIC AND WARP KNITTING MACHINE

(71) Applicant: KARL MAYER STOLL R&D GmbH, Obertshausen (DE)

(72) Inventors: Minoru Ota, Fukui (JP); Kazuhiro Ozawa, Fukui (JP); Tomokazu Igarashi, Fukui (JP); Rieko Kitagawa, Fukui (JP)

(73) Assignee: KARL MAYER STOLL R&D GMBH, Obertshausen (DE)

( * ) Notice: Subject to any disclaimer, the term of this patent is extended or adjusted under 35 U.S.C. 154(b) by 0 days.

(21) Appl. No.: 18/271,316

(22) PCT Filed: Mar. 14, 2023

(86) PCT No.: PCT/JP2023/009839
§ 371 (c)(1),
(2) Date: Jul. 7, 2023

(87) PCT Pub. No.: WO2023/195309
PCT Pub. Date: Oct. 12, 2023

(65) Prior Publication Data

US 2024/0352634 A1 Oct. 24, 2024

(30) Foreign Application Priority Data

Apr. 8, 2022 (JP) ..... 2022-064458

(51) Int. Cl.
*D04B 27/32* (2006.01)
*D04B 21/06* (2006.01)
*D04B 23/02* (2006.01)

(52) U.S. Cl.
CPC ..... *D04B 27/32* (2013.01); *D04B 21/06* (2013.01); *D04B 23/02* (2013.01); *D10B 2403/021* (2013.01)

(58) Field of Classification Search
CPC ..... D04B 27/32; D04B 21/06; D04B 23/02; D10B 2403/021
(Continued)

(56) References Cited

U.S. PATENT DOCUMENTS 3,063,272 A * 11/1962 Bolton ..... D04B 27/32 66/213
3,074,259 A * 1/1963 Rudolph ..... D04B 21/06 66/84 R
(Continued)

FOREIGN PATENT DOCUMENTS

EP 3 385 420 A1 10/2018
JP 2002-4158 A 1/2002
(Continued)

OTHER PUBLICATIONS

Office Action dated Dec. 20, 2023, issued in counterpart TW Application No. 112112035, with English translation. (10 pages).
(Continued)

*Primary Examiner* — Alissa J Tompkins
*Assistant Examiner* — Dakota Marin
(74) *Attorney, Agent, or Firm* — WHDA, LLP

(57) ABSTRACT

A double raschel warp knitting machine including: a pair of frontside jacquard bars JB2, 3 and a pair of backside jacquard bars JB4, 5 as jacquard bars, in which each of the frontside jacquard bars JB2, 3 and the backside jacquard bars JB4, 5 is a half-gauge jacquard bar; and at least one frontside ground guide bar GB1 provided on the front side of the frontside jacquard bars JB2, 3 and at least one backside ground guide bar GB6, 7, 8 provided on the back side of the backside jacquard bars JB4, 5, as ground guide bars. The double raschel warp knitting machine is charac-
(Continued)

terized in that the four half-gauge jacquard bars have jacquard guides at the same positions in the width direction of the knitting machine.

5 Claims, 11 Drawing Sheets

(58) Field of Classification Search
USPC ..... 66/207
See application file for complete search history.

(56) References Cited

U.S. PATENT DOCUMENTS

| | | | | | |
|---|---|---|---|---|---|
| 3,777,514 | A * | 12/1973 | Traumuller | D04B 21/00 | 66/196 |
| 3,864,944 | A * | 2/1975 | Jackson | D04B 21/14 | 66/196 |
| 3,866,443 | A * | 2/1975 | Hunneke | D04B 21/02 | 66/194 |
| 4,051,698 | A * | 10/1977 | Leonhardt | D04B 27/32 | 66/205 |
| 4,052,866 | A * | 10/1977 | Saunders | D04B 21/18 | 222/105 |
| 4,055,201 | A * | 10/1977 | Fowler | D04B 21/18 | 139/389 |
| 4,067,210 | A * | 1/1978 | Arons | D04B 21/14 | 139/420 R |
| 4,100,770 | A * | 7/1978 | Titone | D04B 21/18 | 66/193 |
| 4,137,734 | A * | 2/1979 | Kohl | D04B 27/32 | 66/214 |
| 4,233,824 | A * | 11/1980 | Schneider | D04B 27/06 | 66/87 |
| 4,338,800 | A * | 7/1982 | Matsuda | D04B 35/34 | 66/196 |
| 4,569,212 | A * | 2/1986 | LaRue | D04B 15/50 | 66/196 |
| 4,787,219 | A * | 11/1988 | Sato | B29D 99/0003 | 66/196 |
| 5,033,275 | A * | 7/1991 | Fischer | D04B 27/32 | 66/84 R |
| 5,150,587 | A * | 9/1992 | Bergmann | D04B 27/32 | 66/84 R |
| 5,172,570 | A * | 12/1992 | Wade | D04B 21/06 | 66/195 |
| 5,385,036 | A * | 1/1995 | Spillane | A43B 1/04 | 66/196 |
| 5,390,513 | A * | 2/1995 | Hagel | D04B 27/32 | 66/204 |
| 5,555,750 | A * | 9/1996 | Fischer | D04B 35/34 | 66/203 |
| 5,601,907 | A * | 2/1997 | Matsumoto | D04B 21/10 | 428/134 |
| 5,628,210 | A * | 5/1997 | Mista | D04B 27/02 | 66/203 |
| 6,634,190 | B2 * | 10/2003 | Didier-Laurent | D04B 1/16 | 66/196 |
| 7,293,433 | B1 * | 11/2007 | McMurray | D04B 21/08 | 66/170 |
| 7,757,519 | B2 * | 7/2010 | Lonati | D04B 27/32 | 66/205 |
| 7,992,415 | B2 * | 8/2011 | Lonati | D04B 27/24 | 66/207 |
| 9,677,209 | B2 * | 6/2017 | Daube | D04B 23/02 | |
| 10,899,106 | B1 * | 1/2021 | Cox | B32B 5/26 | |
| 2001/0032484 | A1 * | 10/2001 | Matsuda | D04B 21/06 | 66/193 |
| 2002/0115369 | A1 * | 8/2002 | Yokoyama | D04B 21/06 | 442/304 |
| 2004/0168479 | A1 * | 9/2004 | McMurray | D04B 1/16 | 66/202 |
| 2004/0176658 | A1 * | 9/2004 | McMurray | D04B 21/10 | 66/193 |
| 2010/0055381 | A1 * | 3/2010 | Yamaguchi | D04B 21/02 | 428/91 |
| 2016/0289872 | A1 | 10/2016 | Kieren et al. | | |
| 2017/0107649 | A1 | 4/2017 | Lonati et al. | | |
| 2018/0274140 | A1 * | 9/2018 | Jang | D04B 27/08 | |
| 2020/0063301 | A1 * | 2/2020 | Takayama | D04B 23/22 | |
| 2020/0190713 | A1 * | 6/2020 | Taniguchi | D04B 21/06 | |
| 2023/0002942 | A1 * | 1/2023 | Xu | D04B 21/10 | |

FOREIGN PATENT DOCUMENTS

| | | | |
|---|---|---|---|
| JP | 2008-169533 | A | 7/2008 |
| JP | 2016-148124 | A | 8/2016 |
| JP | 2016-196725 | A | 11/2016 |
| JP | 2018-178291 | A | 11/2018 |
| TW | 201544646 | A | 12/2015 |
| TW | 201837257 | A | 10/2018 |

OTHER PUBLICATIONS

Office Action dated Jun. 18, 2025, issued in counterpart CN Application No. 202380009567.2, with English translation. (10 pages).

Office Action dated Jun. 30, 2025, issued in counterpart KR Application No. 10-2023-7021101, with English translation. (5 pages).

* cited by examiner

METHOD OF KNITTING WARP KNITTED FABRIC AND WARP KNITTING MACHINE

TECHNICAL FIELD

The present invention relates to a method of knitting a warp knitted fabric and a warp knitting machine.

BACKGROUND ART

A double raschel warp knitting machine described in PTL 1, which has a pair of frontside jacquard bars and a pair of backside jacquard bars, is known. Each of the frontside jacquard bars and the backside jacquard bars is a jacquard bar with a half gauge (hereinafter, referred to as a "half-gauge jacquard bar").

In a conventionally known double raschel warp knitting machine, as illustrated in FIG. 11, each half-gauge jacquard bar JB-F1, JB-F2, JB-B1, and JB-B2 has jacquard guides (in the drawing, one vertical line corresponds to one jacquard guide) which correspond to the half of knitting needles.

With a focus on the frontside jacquard bars JB-F1, and JB-F2, the positions of the jacquard guides (positions in the width direction of the knitting machine) are different between one half-gauge jacquard bar JB-F1 and the other half-gauge jacquard bar JB-F2. Specifically, the jacquard guides of these two half-gauge jacquard bars JB-F1, and JB-F2 are alternately arranged.

In the backside jacquard bars JB-B1 and JB-B2 as well, the jacquard guides of the two half-gauge jacquard bars JB-B1 and JB-B2 are alternately arranged in the same manner as in the frontside.

CITATION LIST

Patent Literature

PTL 1: JP2016-148124A

SUMMARY OF INVENTION

Technical Problem

Meanwhile, in the conventionally known above-mentioned double raschel warp knitting machine, supplying different colors of yarns to four half-gauge jacquard bars, respectively, has been examined. Then, a method has been examined in which for each place on a warp knitted fabric, stitches are formed by only one half-gauge jacquard bar so that the place has the color of the yarns of the half-gauge jacquard bar.

However, as mentioned above, since the positions of the jacquard guides (positions in the width direction of the knitting machine) are different between the half-gauge jacquard bars, in this method, for each of the colors of the yarns, a place (wale) where the yarns appear on the surface of the warp knitted fabric is different. Thus, a misalignment occurs between a certain color region and another certain color region. Such a misalignment affects the beauty of the warp knitted fabric.

The present invention has been made in view of such circumstances, and an object thereof is to provide a method of knitting a warp knitted fabric with a beautiful surface, and to provide a warp knitting machine that enables the knitting method.

Solution to Problem

A double raschel warp knitting machine according to an embodiment corresponds to the following [1].

[1] According to an embodiment, a double raschel warp knitting machine includes: a frontside knitting needle row and a backside knitting needle row as a plurality of knitting needle rows; a pair of frontside jacquard bars and a pair of backside jacquard bars as jacquard bars in which jacquard guides are arranged, in which each of the frontside jacquard bars and the backside jacquard bars is a half-gauge jacquard bar; and at least one frontside ground guide bar provided on a front side of the frontside jacquard bars and at least one backside ground guide bar provided on a back side of the backside jacquard bars, as ground guide bars in which guides are arranged. In the double raschel warp knitting machine, the four half-gauge jacquard bars have the jacquard guides at the same positions in a width direction of the knitting machine.

Further, a double raschel warp knitted fabric knitting method according to an embodiment corresponds to the followings [2] to [7].

[2] According to an embodiment, in a method of knitting a double raschel warp knitted fabric, the above-described double raschel warp knitting machine is used, a frontside base fabric is knitted by the frontside ground guide bar, a backside base fabric is knitted by the backside ground guide bar, at a predetermined place, one of the four half-gauge jacquard bars is selected, and the selected half-gauge jacquard bar knits a knit structure where a yarn extends over two or more wales of the backside base fabric and forms stitches on the backside base fabric, and at the same predetermined place, each of unselected three of the half-gauge jacquard bars knits a knit structure where a yarn is inserted into the frontside base fabric.

[3] In the double raschel warp knitted fabric knitting method described in [2], as the predetermined place, at least four places are present, and the different half-gauge jacquard bars are selected for the predetermined places, respectively.

[4] In the double raschel warp knitted fabric knitting method described in [2] or [3], the selected half-gauge jacquard bar knits a knit structure where a yarn forms stitches on the frontside base fabric and the backside base fabric.

[5] In the double raschel warp knitted fabric knitting method described in [2] or [3], the selected half-gauge jacquard bar knits a knit structure where a yarn forms stitches on only the backside base fabric, and in the yarn, a portion between stitches is inserted into the frontside base fabric.

[6] In the double raschel warp knitted fabric knitting method described in any one of [2] to [5], the selected half-gauge jacquard bar knits a knit structure where a yarn overlaps with the backside base fabric by two needles.

[7] In the double raschel warp knitted fabric knitting method described in any one of [2] to [6], the backside ground guide bars are provided in the double raschel warp knitting machine, and stitches are formed on the frontside base fabric by the backside ground guide bar closest to the backside jacquard bars.

Advantageous Effects of Invention

According to the above-described warp knitting machine and the knitting method, it is possible to knit a warp knitted fabric with a beautiful surface.

DESCRIPTION OF EMBODIMENTS

The present embodiment will be described on the basis of drawings. The present embodiment is merely an example, and appropriate modifications within a range not deviating from the spirit of the present invention shall be included in the scope of the present invention.

Figure 1:
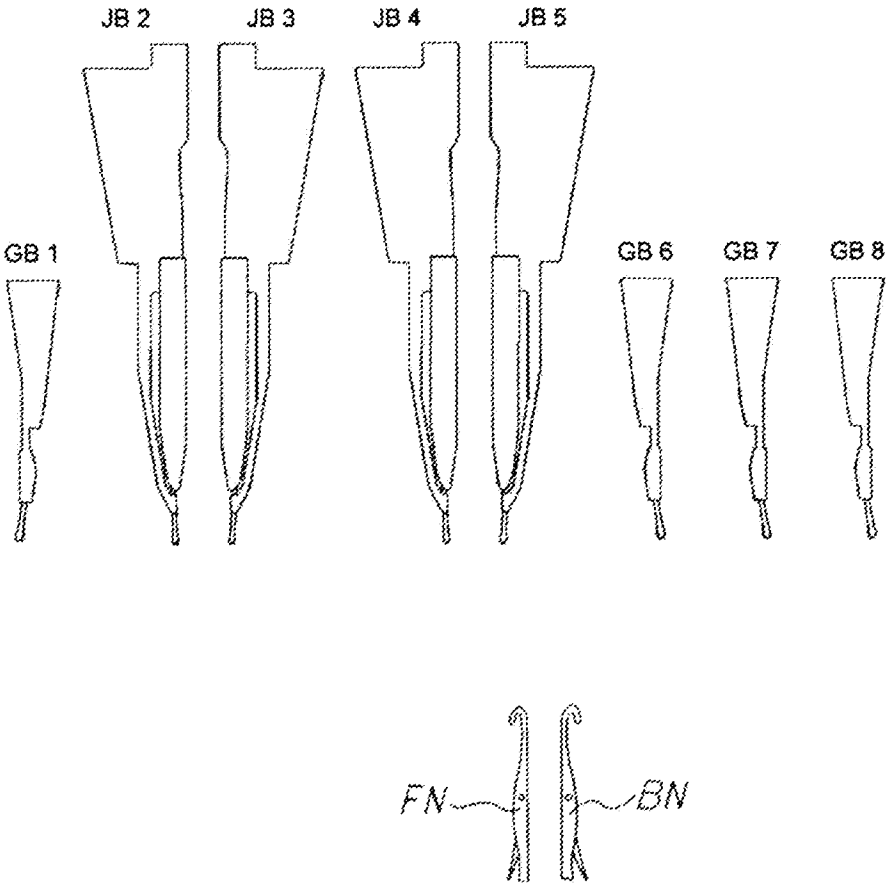
FIG. 1 is a view illustrating the arrangement of guide bars in a double raschel warp knitting machine when the warp knitting machine is viewed from the side.

A warp knitting machine of the present embodiment has a structure illustrated in FIG. 1. The direction perpendicular to the paper surface of FIG. 1 is the width direction of the warp knitting machine (hereinafter, referred to as the "width direction of the knitting machine"). Further, the left-right direction of FIG. 1 is the front-rear direction of the warp knitting machine (hereinafter, referred to as the "front-rear direction of the knitting machine"). In FIG. 1, the left is the front, and the right is the rear (back).

As illustrated in FIG. 1, the warp knitting machine of the present embodiment is a double raschel warp knitting machine having a frontside knitting needle row FN and a backside knitting needle row BN. Each of the frontside knitting needle row FN and the backside knitting needle row BN has many knitting needles arranged in a row in the width direction of the knitting machine. The frontside knitting needle row FN is a row of knitting needles for knitting the frontside base fabric, and the backside knitting needle row BN is a row of knitting needles for knitting the backside base fabric.

Further, the double raschel warp knitting machine of the present embodiment is a so-called double jacquard double raschel warp knitting machine having a pair of frontside jacquard bars JB2 and JB3 (hereinafter, "front jacquard bars JB2 and JB3") and a pair of backside jacquard bars JB4 and JB5 (hereinafter, "back jacquard bars JB4 and JB5"). In each of the jacquard bars JB2, JB3, JB4, and JB5, jacquard guides are arranged in the width direction of the knitting machine.

Each of the jacquard bars JB2, JB3, JB4, and JB5 performs a basic movement for knitting a basic structure. Along with this, the plurality of jacquard guides provided on each of the jacquard bars JB2, JB3, JB4, and JB5 performs a basic movement for knitting a basic structure.

In addition to the basic movement for knitting the basic structure, each of these jacquard guides is independently displaceable by the action of a jacquard mechanism. Thus, the jacquard guides can perform different movements, respectively. When the jacquard mechanism operates, the jacquard guides are displaced from the positions where the basic structure is being knitted, by a distance of 1 G (an interval between two adjacent knitting needles), in the width direction of the knitting machine. It is possible to allow the jacquard mechanism to work during only overlapping, to work during only underlapping, or to work during both overlapping and underlapping.

Further, the warp knitting machine of the present embodiment includes at least one ground guide bar (a frontside ground guide bar) on the front side of the front jacquard bars JB2 and JB3, and includes at least one ground guide bar (a backside ground guide bar) on the back side of the back jacquard bars JB4 and JB5.

In FIG. 1, one ground guide bar GB1 is provided as the ground guide bar on the front side of the front jacquard bars JB2 and JB3. Further, three ground guide bars GB6, GB7, and GB8 are provided as the ground guide bars on the back side of the back jacquard bars JB4, and JB5. In each of the ground guide bars GB1, GB6, GB7, and GB8, guides are arranged in the width direction of the knitting machine.

Each of the ground guide bars GB1, GB6, GB7, and GB8 performs a basic movement for knitting a knit structure. Unlike the jacquard guides, the guides provided on each of the ground guide bars GB1, GB6, GB7, and GB8 cannot perform a different movement from other guides provided on the same ground guide bar.

Figure 2:
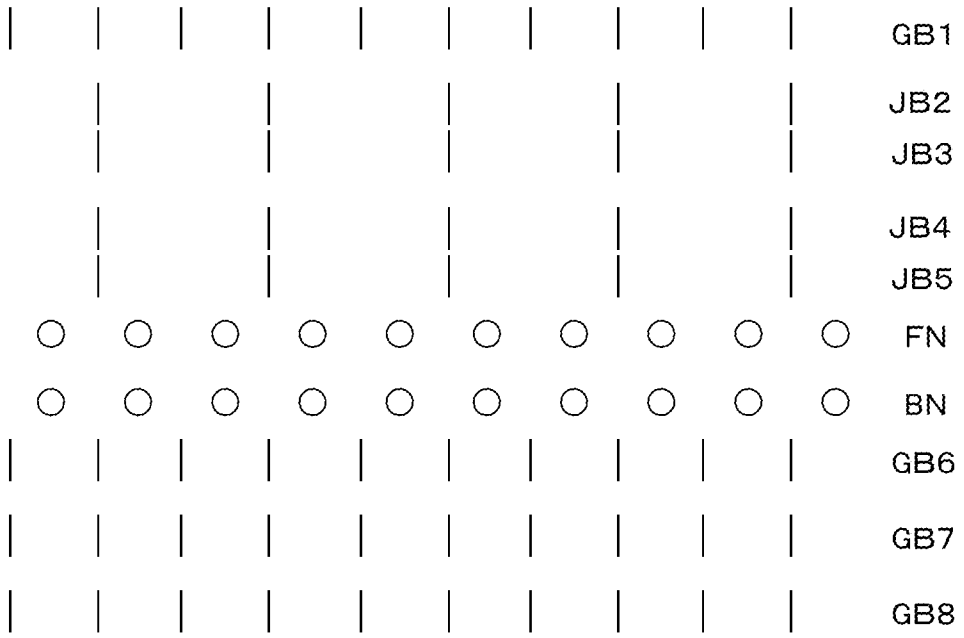
FIG. 2 is a view illustrating the arrangement of knitting needles and guides when the warp knitting machine is viewed from above.

FIG. 2 illustrates the arrangement of components such as the guides of the ground guide bars GB1, GB6, GB7, and GB8. In FIG. 2, the left-right direction is the width direction of the knitting machine, and the vertical direction is the front-rear direction of the knitting machine. Further, in FIG. 2, each of vertical lines drawn in the rows of GB1, GB6, GB7, and GB8 means a guide. Further, each of vertical lines drawn in the rows of JB2 to JB5 means a jacquard guide. Further, each of circles drawn in the rows of FN and BN means a knitting needle. In an actual warp knitting machine, more guides and knitting needles than in FIG. 2 are provided.

As illustrated in FIG. 2, each of the ground guide bars GB1, GB6, GB7, and GB8 is a full-gage guide bar. That is, in each of the ground guide bars GB1, GB6, GB7, and GB8, the number of guides per inch is the same as the number of knitting needles per inch, and each guide is disposed at a position corresponding to each knitting needle.

Meanwhile, as illustrated in FIG. 2, each of the jacquard bars JB2, JB3, JB4, and JB5 is a half-gauge jacquard bar. Here, a jacquard bar, in which the number of jacquard guides per inch is half of the number of knitting needles per inch, and the jacquard guides are arranged at a ratio of one jacquard guide to two knitting needles, is referred to as a "half-gauge jacquard bar".

When two jacquard bars JB2 and JB3 are matched, the same number of jacquard guides as the number of knitting needles are prepared. Further, when two jacquard bars JB4 and JB5 are matched, the same number of jacquard guides as the number of knitting needles are prepared. As can be seen from FIG. 2, in each of the four jacquard bars JB2, JB3, JB4, and JB5, one jacquard guide is disposed for every two knitting needles.

Then, the respective jacquard guides of the four jacquard bars JB2, JB3, JB4, and JB5 are arranged at the same positions in the width direction of the knitting machine. Therefore, the jacquard guides of the four jacquard bars JB2, JB3, JB4, and JB5 are arranged in rows in the front-rear direction of the knitting machine.

In the arrangement of FIG. 1, at least the ground guide bar GB1 to the ground guide bar GB6 can overlap with the frontside knitting needle row FN. Further, at least the front jacquard bars JB2 and JB3 to the ground guide bar GB8 can overlap with the backside knitting needle row BN. A yarn pulled out of a creel (not illustrated) is threaded through each of the jacquard bars JB2, JB3, JB4, and JB5 (threading is that a yarn passes through a guide).

Basic movements of the frontside knitting needle row FN, the backside knitting needle row BN, the ground guide bars GB1, GB6, GB7, and GB8 and the jacquard bars JB2, JB3, JB4, and JB5 are controlled by a controller. Further, the action of the jacquard mechanism is controlled by the same or different controller as the controller that controls the basic movements.

Otherwise, the warp knitting machine of the present embodiment has the same structure as a known double raschel warp knitting machine.

A warp knitted fabric is knitted by the warp knitting machine having the above structure. The outline of the knitting method is as follows.

First, in knitting the warp knitted fabric, yarns are threaded through all the guides of the ground guide bars GB1, GB6, GB7, and GB8, respectively. Accordingly, the same number of yarns as the number of knitting needles included in one knitting needle row are threaded through each of the ground guide bars GB1, GB6, GB7, and GB8. Further, yarns are threaded through all the jacquard guides of the jacquard bars JB2, JB3, JB4, and JB5, respectively. Accordingly, yarns corresponding to half of the number of knitting needles included in one knitting needle row are threaded through each of the jacquard bars JB2, JB3, JB4, and JB.

The respective guides of the ground guide bars GB1, GB6, GB7, and GB8 and the respective jacquard guides of the jacquard bars JB2, JB3, JB4, and JB5, through which the yarns are threaded in this manner, operate with respect to the respective knitting needles of the frontside knitting needle row FN and the backside knitting needle row BN so as to perform knitting of the warp knitted fabric.

In knitting the warp knitted fabric, the frontside base fabric is knitted by the frontside ground guide bar GB1. As will be described below, since the yarns supplied from the ground guide bar GB6 are knitted into the frontside base fabric, it can also be said that the ground guide bar GB6 also performs knitting of the frontside base fabric. Further, in parallel with knitting of the frontside base fabric, the backside base fabric is knitted by the backside ground guide bars GB7 and GB8.

Further, in parallel with knitting of the frontside base fabric and the backside base fabric, structures are formed by the jacquard bars JB2, JB3, JB4, and JB5. The respective jacquard mechanisms of the jacquard bars JB2, JB3, JB4, and JB5 perform different actions depending on places so that yarns supplied from the jacquard bars JB2, JB3, JB4, and JB5 (hereinafter, referred to as "jacquard yarns") form different structures depending on places. As the different structures, a structure, in which the jacquard yarn forms stitches on both the frontside base fabric and the backside base fabric, or a structure, in which the jacquard yarn does not form stitches on any of the base fabrics and is inserted into the frontside base fabric, may be mentioned.

The jacquard yarns knitted into the frontside base fabric and the backside base fabric appear on the surfaces of these base fabrics to form a jacquard pattern. Here, the jacquard pattern is a pattern formed by the jacquard yarns appearing on the surface of the warp knitted fabric. Further, the jacquard yarns knitted into both the frontside base fabric and the backside base fabric connect these base fabrics.

Further, the yarns supplied from the ground guide bar GB6 (the backside ground guide bar closest to the back jacquard bars JB4 and JB5) form stitches on the frontside base fabric and are knitted into the frontside base fabric. Therefore, among the jacquard yarns present on the front side of the ground guide bar GB6, a portion where an insertion structure is formed is pressed against the frontside base fabric by the yarns supplied from the ground guide bar GB6. It can be said that the insertion yarns pressed against the frontside base fabric in this manner are inserted into the frontside base fabric.

Figure 3:
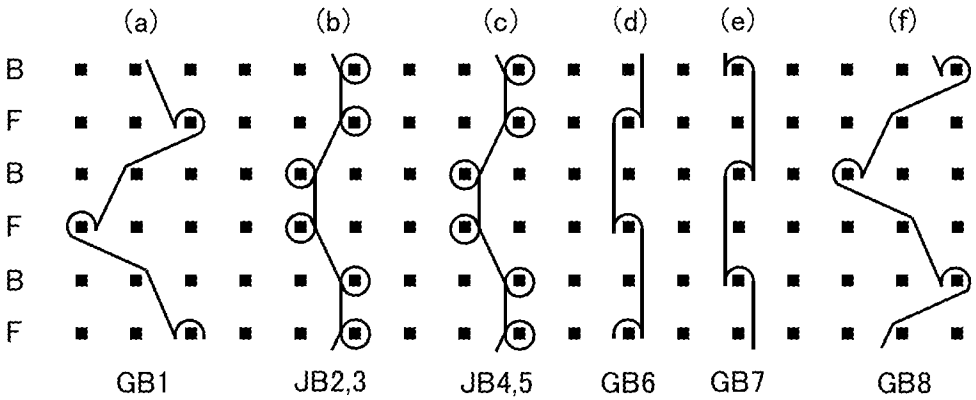
FIG. 3 is structure diagrams made by ground guide bars and jacquard bars.
Figure 4:
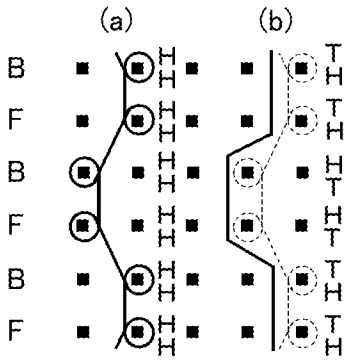
FIG. 4 is structure diagrams made by jacquard bars when stitches of any of jacquard yarns are formed on a backside base fabric.
Figure 5:
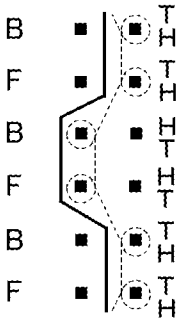
FIG. 5 is a structure diagram made by jacquard bars when all jacquard yarns are inserted into a frontside base fabric.

Next, descriptions will be made on a more detailed example of a knitting method. FIG. 3 to FIG. 5 are specific structure diagrams of the present embodiment. In each structure diagram, F indicates a course knitted by the frontside knitting needle row FN, and B indicates a course knitted by the backside knitting needle row BN.

FIG. 3 illustrates knit structures made by the ground guide bars GB1, GB6, GB7, and GB8. Further, knit structures made by the jacquard bars JB2, JB3, JB4, and JB5, which are basic structures, are also illustrated. The basic structure is a knit structure in a case where the jacquard mechanism is not operated.

As illustrated in (a) of FIG. 3, the knit structure of the ground guide bar GB1 is a knit structure in which stitches are formed on the frontside base fabric. The knit structure in (a) of FIG. 3 is represented by 0-1-1-1/3-2-2-2// as chain numbers. In this manner, the frontside base fabric is knitted by the ground guide bar GB1.

In the notation of these chain numbers, among four numbers within a range separated by "/", the first two (0-1 and 3-2 in the above example) indicate the action on the knitting needles of the frontside knitting needle row FN, and the latter two (1-1 and 2-2 in the above example) indicate the action on the knitting needles of the backside knitting needle row BN.

Further, as illustrated in (d) of FIG. 3, the knit structure of the ground guide bar GB6 is a knit structure in which stitches are formed on the frontside base fabric. The knit structure in (d) of FIG. 3 is represented by 1-0-0-0/0-1-1-1// as chain numbers. The yarns supplied from the ground guide bar GB6 are knitted into the frontside base fabric in this manner, so that the jacquard yarns present on the front side of the ground guide bar GB6 are pressed against the frontside base fabric.

Further, as illustrated in (e) of FIG. 3, the knit structure of the ground guide bar GB7 is a knit structure in which stitches are formed on the backside base fabric. The knit structure in (e) of FIG. 3 is represented by 0-0-0-1/1-1-1-0// as chain numbers. Further, as illustrated in (f) of FIG. 3, the knit structure of the ground guide bar GB8 is a knit structure in which stitches are formed on the backside base fabric. The knit structure in (f) of FIG. 3 is represented by 2-2-0-1/1-1-3-2// as chain numbers.

In this manner, the backside base fabric is knitted by the two ground guide bars GB7 and GB8. The knit structure knitted by the two ground guide bars GB7 and GB8 is a kind of Queens cord (a structure including a chain knit structure and a cord structure that underlaps by two or more needles, in which yarns of the cord structure are pressed by the chain stitch yarns). The Queens cord is known as a stable structure with low elasticity.

FIG. 3 also illustrates basic structures made by the jacquard bars JB2, JB3, JB4, and JB5. As illustrated in (b) of FIG. 3, the basic structure made by the front jacquard bars JB2 and JB3 is a knit structure in which stitches are formed on the frontside base fabric and the backside base fabric. Further, the basic structure made by the front jacquard bars JB2 and JB3 is a knit structure in which the jacquard yarn is knitted over two knitting needles (therefore, in a warp knitted fabric 10, the jacquard yarn extends over two wales). The chain numbers of the basic structure in (b) of FIG. 3 are 1-0-1-0/1-2-1-2//.

As illustrated in (c) of FIG. 3, the basic structure made by the back jacquard bars JB4 and JB5 is a knit structure in which stitches are formed on the frontside base fabric and the backside base fabric. Further, the basic structure made by the back jacquard bars JB4 and JB5 is a knit structure in which the jacquard yarn is knitted over two knitting needles (therefore, in the warp knitted fabric 10, the jacquard yarn extends over two wales). The chain numbers of the basic structure in (c) of FIG. 3 are 1-0-1-0/1-2-1-2//. The yarns in each of the basic structures in (b) and (c) of FIG. 3 form a checkered pattern on the frontside base fabric and the backside base fabric.

FIG. 4 and FIG. 5 illustrate knit structures when the jacquard mechanism operates. In FIG. 4 and FIG. 5, the basic structure made by the jacquard bars JB2, JB3, JB4, and JB5 is indicated by s dashed line. Then, an example of the knit structure made by the jacquard bars JB2, JB3, JB4, and JB5 in a case where the jacquard mechanism operates is indicated by a solid line.

In each knit structure diagram, H in the drawing indicates that the jacquard mechanism is not operated. In this case, the jacquard guides are present at the same positions as when the basic structure is knitted. Further, T in the drawing indicates that the jacquard mechanism is operated. In this case, the jacquard guides are displaced from the positions where the basic structure is knitted. T and H are written at the top and bottom of one needle position, but the top T or H indicates that the jacquard mechanism is operated or not operated during overlapping, and the bottom T or H indicates that the jacquard mechanism is operated or not operated during underlapping.

The knit structure of FIG. 4 is a knit structure for knitting a yarn of any one jacquard bar into the backside base fabric so that the yarn appears on the surface of the backside base fabric (the backside surface of the warp knitted fabric). The knit structure in (a) of FIG. 4 is a knit structure realized without the action of the jacquard mechanism, and is the same as the basic structures in (b) and (c) of FIG. 3. Further, the knit structure in (b) of FIG. 4 is a knit structure when the jacquard mechanism is operated during underlapping and/or overlapping in all courses of the basic structure. The chain numbers of the knit structure in (b) of FIG. 4 are 1-1-1-1/2-2-2-2//.

As is clear from the drawing, the jacquard yarn in the knit structure in (a) of FIG. 4 is knitted into both the frontside base fabric and the backside base fabric, and appears on the surface of the frontside base fabric and the surface of the backside base fabric. Further, the jacquard yarn is knitted over two knitting needles. Further, the jacquard yarn forms a checkered pattern on the frontside base fabric and the backside base fabric.

The jacquard yarn in the knit structure in (a) of FIG. 4 is knitted into both the frontside base fabric and the backside base fabric, and thus connect the frontside base fabric to the backside base fabric. Specifically, a needle loop formed on the frontside base fabric and a needle loop formed on the backside base fabric are connected by a sinker loop of the jacquard yarn forming these needle loops. In this manner, the yarn that forms needle loops on the frontside base fabric and the backside base fabric and connects the two base fabrics is also called a "double-side loop pile".

Further, the jacquard yarn in the knit structure in (b) of FIG. 4 is inserted into the frontside base fabric and does not appear on the surface of the frontside base fabric and the surface of the backside base fabric. When the knit structure in (b) of FIG. 4 is formed, the jacquard yarn does not connect the frontside base fabric and the backside base fabric.

Further, FIG. 5 is a knit structure of the jacquard bars JB2, JB3, JB4, and JB5 when each jacquard yarn is inserted into the frontside base fabric. The knit structure of FIG. 5 is the same as the knit structure in (b) of FIG. 4. The jacquard yarn in the knit structure of FIG. 5 is inserted into the frontside base fabric and does not appear on the surface of the frontside base fabric and the surface of the backside base fabric. Further, the jacquard yarn in the knit structure of FIG. 5 does not connect the frontside base fabric and the backside base fabric.

When the jacquard yarn is inserted between the frontside base fabric and the backside base fabric, the insertion portion becomes unstable as it is. However, when the yarn supplied from the ground guide bar GB6 is knitted into the frontside base fabric as described above, the insertion portion of the jacquard yarn is pressed against the frontside base fabric and is stabilized.

In knitting in the present embodiment, the knitting of the knit structures of FIG. 3 to FIG. 5 described above is executed. Specifically, the knit structures of FIG. 3 are knitted by the ground guide bars GB1, GB6, GB7, and GB8.

At the same time, at a predetermine place on the warp knitted fabric, any one of the jacquard bars JB2, JB3, JB4, and JB5 is selected, and the knit structure of the selected jacquard bar becomes the knit structure in (a) of FIG. 4. Then, the knit structure of the remaining three jacquard bars becomes the knit structure in (b) of FIG. 4. Then, only the jacquard yarn in the knit structure in (a) of FIG. 4 is knitted into both the frontside base fabric and the backside base fabric, and appears on the surface of the frontside base fabric and the surface of the backside base fabric. A plurality of places is provided on the warp knitted fabric and one of the four jacquard bars JB2, JB3, JB4, and JB5 is selected for each place. Then, the knit structure in (a) of FIG. 4 is knitted by the selected jacquard bar.

During knitting of the present embodiment, different colors of yarns are threaded through the jacquard bars JB2, JB3, JB4, and JB5, respectively. Further, through the ground guide bars GB7 and GB8 that knit the backside base fabric, yarns having a yarn different from those of the jacquard bars JB2, JB3, JB4, and JB5 are threaded. Here, the same color of yarns are threaded through the ground guide bar GB7 and the ground guide bar GB8. The material or thickness (fineness) of each yarn is not limited. As the material for the yarns, natural fibers such as silk or cotton or synthetic fibers made of polyester or nylon may be employed. Further, as for the yarns, various things such as filament yarns or spun yarns may be employed.

In a state where threading is performed in this manner, as described above, for each place of the warp knitted fabric, jacquard yarns of one jacquard bar selected from the jacquard bars JB2, JB3, JB4, and JB5 are knitted as the knit structure in (a) of FIG. 4, and jacquard yarns of the other jacquard bars are knitted as the knit structure in (b) of FIG. 4. Accordingly, the color of the portion on the frontside base fabric and the backside base fabric becomes the color of the jacquard yarns of the selected jacquard bar.

As such a place, at least four places are provided on the warp knitted fabric, and for each place, one of the four jacquard bars JB2, JB3, JB4, and JB5 is selected to knit the knit structure in (a) of FIG. 4. Then, each of the four jacquard bars JB2, JB3, JB4, and JB5 is selected at least once.

Further, in a part of the warp knitted fabric, the knit structure of the jacquard bars JB2, JB3, JB4, and JB5 becomes the knit structure of FIG. 5. The yarn in the knit structure of FIG. 5 does not appear on the surface of the frontside base fabric and the surface of the backside base fabric. Therefore, in the portion of the knit structure of FIG. 5, the color of the frontside base fabric surface becomes the color of yarns of the ground guide bars GB1 and GB6, and the color of the backside base fabric surface becomes the color of yarns of the ground guide bars GB7 and GB8.

In this manner, in the warp knitted fabric, a portion where jacquard yarns of any of the jacquard bars JB2, JB3, JB4, and JB5 appear on the surface of the backside base fabric, or a portion where no jacquard appears on the surface of the backside base fabric is formed. As a result, on the backside base fabric, a jacquard pattern with different colors of portions is formed.

As described above, different colors of yarns are threaded through the jacquard bars JB2, JB3, JB4, and JB5, respectively, and yarns having a different yarn are threaded through the ground guide bars GB7 and GB8. Thus, a jacquard pattern composed of five colors is formed on the backside base fabric. Further, on the frontside base fabric as well, a jacquard pattern with different colors of portions is formed.

Figure 6:
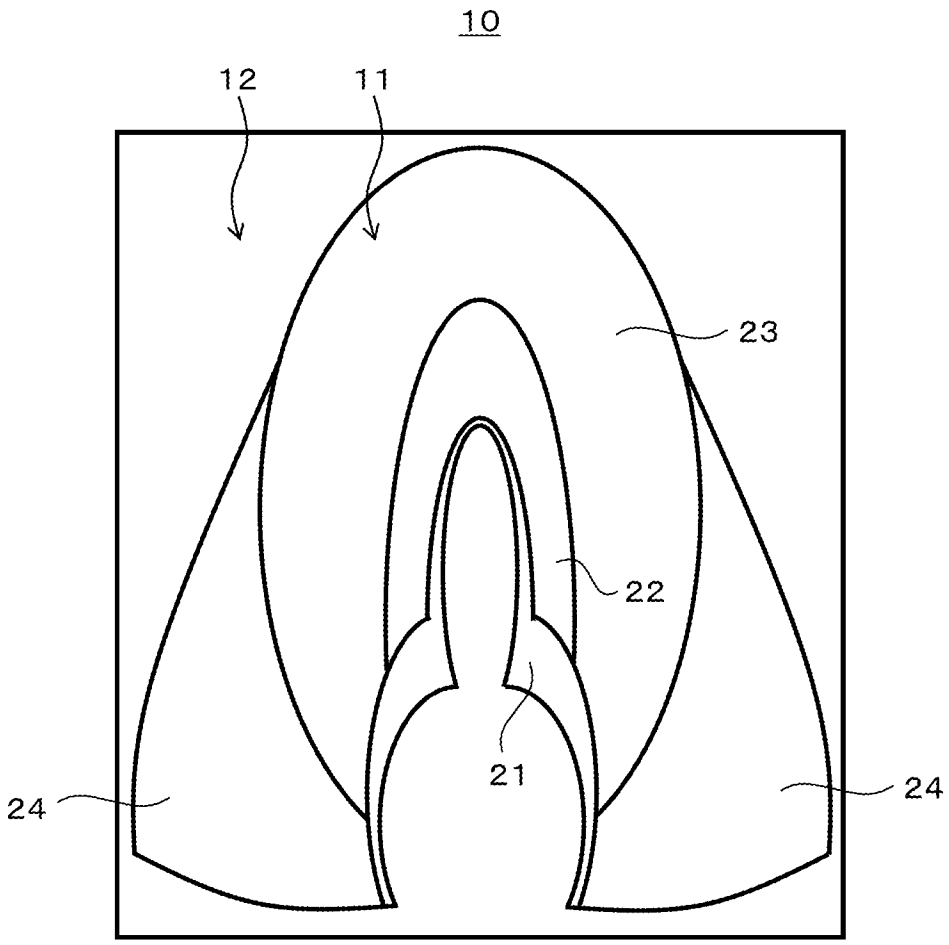
FIG. 6 is a plan view of a backside base fabric of a warp knitted fabric.

The warp knitted fabric 10 of FIG. 6 is the warp knitted fabric 10 composed of the knit structures of FIG. 3 to FIG. 5, which is knitted by the double raschel warp knitting machine. In FIG. 6, the surface of the backside base fabric of the warp knitted fabric 10 is drawn. The warp knitted fabric 10 is formed by integrally knitting an upper portion 11 used for a shoe upper and its peripheral portion 12. In the upper portion 11, a first portion 21, a second portion 22, a third portion 23, and a fourth portion 24 are set in order from the portion near a shoe tongue.

The first portion 21 to the fourth portion 24 and the peripheral portion 12 have different colors, respectively. In the present embodiment, the first portion 21 is yellow, the second portion 22 is white, the third portion 23 is light blue, and the fourth portion 24 is blue. Further, the peripheral portion 12 is almost gray.

In knitting the warp knitted fabric 10 of FIG. 6, translucent yarns, yellow yarns, white yarns, light blue yarns, blue yarns, and translucent yarns are threaded through the ground guide bar GB1, the jacquard bar JB2, the jacquard bar JB3, the jacquard bar JB4, the jacquard bar JB5, and the ground guide bars GB6 to GB8, respectively. Here, each of the translucent yarns threaded through the ground guide bars GB1, and GB6 to GB8 is a monofilament thread. Further, the yarns threaded through the jacquard bars JB2 to JB5 (jacquard yarns) are processed threads.

In the entire warp knitted fabric 10, the knitting of the knit structures of FIG. 3 is executed by the ground guide bars GB1, and GB6 to GB8. Meanwhile, the knit structures made by the jacquard bars JB2 to JB5 vary depending on places.

In knitting the first portion 21, the knit structure in (a) of FIG. 4, in which stitches are formed on the frontside base fabric and the backside base fabric, is knitted by the jacquard bar JB2 through which the yellow yarns have passed. Further, the knit structure in (b) of FIG. 4, in which jacquard yarns are inserted into the frontside base fabric, is knitted by the other jacquard bars JB3 to JB5. Thus, among the jacquard yarns, only the yellow yarns appear on the surface of the backside base fabric, and the first portion 21 becomes yellow.

In knitting the second portion 22, the knit structure in (a) of FIG. 4, in which stitches are formed on the frontside base fabric and the backside base fabric, is knitted by the jacquard bar JB3 through which the white yarns have passed. Further, the knit structure in (b) of FIG. 4, in which jacquard yarns are inserted into the frontside base fabric, is knitted by the other jacquard bars JB2, JB4 and JB5. Thus, among the jacquard yarns, only the white yarns appear on the surface of the backside base fabric, and the second portion 22 becomes white.

In knitting the third portion 23, the knit structure in (a) of FIG. 4, in which stitches are formed on the frontside base fabric and the backside base fabric, is knitted by the jacquard bar JB4 through which the light blue yarns have passed. Further, the knit structure in (b) of FIG. 4, in which jacquard yarns are inserted into the frontside base fabric, is knitted by the other jacquard bars JB2, JB3 and JB5. Thus, among the jacquard yarns, only the light blue yarns appear on the surface of the backside base fabric, and the third portion 23 becomes light blue.

In knitting the fourth portion 24, the knit structure in (a) of FIG. 4, in which stitches are formed on the frontside base fabric and the backside base fabric, is knitted by the jacquard bar JB5 through which the blue yarns have passed. Further, the knit structure in (b) of FIG. 4, in which jacquard yarns are inserted into the frontside base fabric, is knitted by the other jacquard bars JB2, JB3 and JB4. Thus, among the jacquard yarns, only the blue yarns appear on the surface of the backside base fabric, and the fourth portion 24 becomes blue.

In this manner, on the surface of the backside base fabric, a jacquard pattern composed of the first to fourth portions 21 to 24 classified by colors is formed. In the first portion 21 to the fourth portion 24, since jacquard yarns form stitches on both the frontside base fabric and the backside base fabric, the frontside base fabric and the backside base fabric are connected.

Further, since the jacquard yarns form stitches on both the frontside base fabric and the backside base fabric, the same jacquard pattern as that on the backside is also formed on the surface of the frontside base fabric of the warp knitted fabric 10.

Further, in knitting the peripheral portion 12, the knit structure made by the jacquard bars JB2 to JB5 is basically the insertion structure of FIG. 5. Meanwhile, it is preferable that the frontside base fabric and the backside base fabric are connected in the peripheral portion 12 as well. Therefore, in some places of the peripheral portion 12, the knit structure in (a) of FIG. 4 is knitted by any of the jacquard yarns.

After being knitted by the above method, the warp knitted fabric is subjected to finishing such as heat setting. The warp knitted fabric actually knitted by the warp knitting machine has the upper portions 11 arranged vertically and horizontally. In an appropriate process after knitting, a plurality of upper portions 11 is separated and collected from one warp knitted fabric. The collected upper portion 11 is used as a shoe upper.

It is possible to knit a warp knitted fabric with a beautiful surface by the above-described double raschel warp knitting machine and the knitting method based on the same.

Specifically, in the double raschel warp knitting machine of the present embodiment, a pair of frontside jacquard bars JB2 and JB3 and a pair of backside jacquard bars JB4 and JB5 are provided, and these jacquard bars JB2, JB3, JB4, and JB5 are half-gauge jacquard bars, respectively. Thus, at a predetermined place, it is possible to knit a knit structure in which stitches are formed on the backside base fabric by any one selected half-gauge jacquard bar, and jacquard yarns are inserted into the frontside base fabric by the remaining three half-gauge jacquard bars.

Then, different colors of jacquard yarns are threaded through the four half-gauge jacquard bars JB2, JB3, JB4, and JB5 when the knit structures are knitted. This makes it possible for only different colors of yarns to appear at respective places on the surface of the backside base fabric, and a beautiful jacquard pattern can be formed.

Further, in the double raschel warp knitting machine of the present embodiment, the four half-gauge jacquard bars JB2, JB3, JB4, and JB5 are provided with jacquard guides at the same positions in the width direction of the knitting machine as in FIG. 2. Therefore, jacquard yarns of all the half-gauge jacquard bars can form stitches in the same wale of the backside base fabric. Thus, no misalignment occurs in boundaries between different colors of places when different colors of jacquard yarns are threaded through four half-gauge jacquard bars JB2, JB3, JB4, and JB5 and knitting is performed such that only different colors of yarns are allowed to appear on respective places, on the surface of the backside base fabric as described above. Therefore, it is possible to form a beautiful jacquard pattern without alignment.

Further, in the half-gauge jacquard bar, only one jacquard guide is provided for two knitting needles. Thus, when each jacquard yarn is knitted into only one wale of the backside base fabric, a wale into which the jacquard yarn is knitted and a wale into which the jacquard yarn is not knitted are alternately present. Then, a vertical stripe having the color of the jacquard yarn can be made on the warp knitted fabric.

However, in the knitting method of the present embodiment, since the jacquard yarn is knitted over two or more wales of the backside base fabric, the jacquard yarn is knitted into all wales. Thus, a vertical stripe having the color of the jacquard yarn is not formed on the warp knitted fabric, and the entire place where the jacquard yarn forms stitches seems to have the color of the jacquard yarn.

Here, as a knit structure in which the jacquard yarn is knitted over two or more wales on the backside base fabric, a knit structure in which a checkered pattern is formed on the backside base fabric is knitted. Therefore, at a predetermined place on the warp knitted fabric, a jacquard yarn of a specific color appears to form a checkered pattern on the backside base fabric. When the backside base fabric is viewed from a distance, the predetermined place seems to have the color as a whole.

Further, in the knitting method of the present embodiment, there are at least four predetermined places where jacquard yarns form stitches on the backside base fabric, and then different half-gauge jacquard bars are selected for the predetermined places, respectively. Thus, a jacquard pattern composed of four colors can be formed on the warp knitted fabric. Further, yarns having a color different from those of the jacquard yarns may be threaded through the backside ground guide bars GB7 and GB8 so that the backside base fabric of the warp knitted fabric can have five colors.

Further, in the knitting method of the present embodiment, by any one of the half-gauge jacquard bars JB2, JB3, JB4, and JB5, a knit structure, in which a jacquard yarn forms stitches on the frontside base fabric and the backside base fabric, is knitted. Accordingly, a jacquard pattern can be formed on both the frontside base fabric and the backside base fabric, and moreover, the frontside base fabric and the backside base fabric can be connected by jacquard yarns.

Further, since stitches are formed on the frontside base fabric by the backside ground guide bar GB6 closest to the backside jacquard bars JB4 and JB5, jacquard yarns can be pressed toward the frontside base fabric, and the jacquard yarns can be stabilized.

Further, in the knitting method of the present embodiment, a Queen's cord is knitted as a knit structure of the backside base fabric by the two ground guide bars GB7 and GB8. Thus, the entire warp knitted fabric becomes a stable warp knitted fabric with low elasticity.

Any one of modifications described below can be applied to the above embodiment. Further, a combination of two or more of the modifications described below can also be applied to the above embodiment within a possible range. Further, besides the following modifications, various modification can be made.

<Modification 1>

Figure 7:
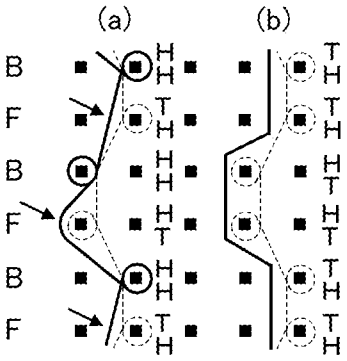
FIG. 7 is a modification of a structure diagram made by jacquard bars when stitches of any of jacquard yarns are formed on the backside base fabric.

FIG. 7 illustrates a modification of the knit structure of the jacquard bars JB2, JB3, JB4, and JB5. Both (a) and (b) of FIG. 7 are knit structures in knitting performed by actions of jacquard mechanisms.

The knit structure in (a) of FIG. 7 is a knit structure in which stitches are formed on the backside base fabric and stitches are not formed on the frontside base fabric. The chain numbers of the knit structure are 1-1-1-0/2-2-1-2//. The jacquard yarn in the knit structure in (a) of FIG. 7 is knitted into only the backside base fabric and appears on only the backside base fabric surface. Further, in the jacquard yarn of the knit structure in (a) of FIG. 7, a portion between stitches (this portion is indicated by arrows in (a) of FIG. 7) is inserted into the frontside base fabric. Further, the knit structure in (b) of FIG. 7 is the same as the knit structure in (b) of FIG. 4. The jacquard yarn of the knit structure in (b) of FIG. 7 is inserted into the frontside base fabric and does not appear on the surface of the backside base fabric and the surface of the frontside base fabric.

During the knitting in this modification, at a predetermined place of the warp knitted fabric, the knit structure of any one of the four jacquard bars JB2, JB3, JB4, and JB5 becomes the knit structure in (a) of FIG. 7, and the knit structure of the remaining three jacquard bars becomes the knit structure in (b) of FIG. 7. Then, at the predetermined place, only the jacquard yarn in the knit structure in (a) of FIG. 7 appears on the surface of the backside base fabric, and the other jacquard yarns do not appear on the surface of the backside base fabric. A multicolored jacquard pattern is formed on the backside base fabric by selecting different jacquard bars for respective places.

Further, on the surface of the frontside base fabric, none of jacquard yarns of the jacquard bars JB2, JB3, JB4, and JB5 appear. Thus, in the warp knitted fabric using the knit structure of the modification, a jacquard pattern is formed on the surface of the backside base fabric whereas no jacquard pattern is formed on the surface of the frontside base fabric. The surface of the frontside base fabric has the color of yarns of the ground guide bars GB1 and GB6.

In the case of this modification, in the jacquard yarn of the knit structure in (a) of FIG. 7, the portion between stitches is inserted into the frontside base fabric. The knit structure of the ground guide bar GB6 becomes a knit structure of Modification 3 (see FIG. 9) in order to press and stabilize the insertion portion and to connect the frontside base fabric to the backside base fabric. According to the knit structure of Modification 3, the yarn of the ground guide bar GB6 is knitted into the frontside base fabric. Thus, the yarn of the ground guide bar GB6 presses the insertion portion of the jacquard yarn of the knit structure in (a) of FIG. 7 against the frontside base fabric. Further, according to the knit structure of Modification 3, the yarn of the ground guide bar GB6 connects the frontside base fabric to the backside base fabric.

<Modification 2>

Figure 8:
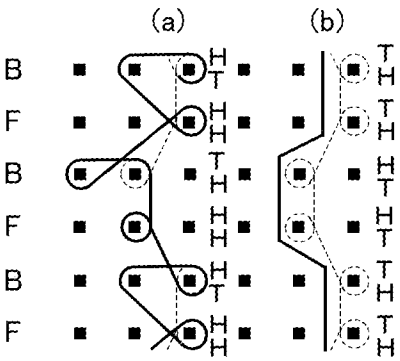
FIG. 8 is a modification of a structure diagram made by jacquard bars when stitches of any of jacquard yarns are formed on the backside base fabric.

FIG. 8 illustrates a modification of the knit structure of the jacquard bars JB2, JB3, JB4, and JB5. Both (a) and (b) of FIG. 8 are knit structures in knitting performed by actions of jacquard mechanisms.

The knit structure in (a) of FIG. 8 is a knit structure in which stitches are formed on the frontside base fabric and the backside base fabric. The chain numbers of the knit structure are 1-0-2-0/1-2-1-3//. As can be seen from the chain numbers, the jacquard bar that knits the knit structure in (a) of FIG. 8 overlaps with knitting needles of the frontside knitting needle row FN, by one stitch, and overlaps with knitting needles of the backside knitting needle row BN, by two stitches. Further, the knit structure in (b) of FIG. 8 is the same as the knit structure in (b) of FIG. 4. The jacquard yarn of the knit structure in (b) of FIG. 8 is inserted into the frontside base fabric and does not appear on the backside base fabric surface and the frontside base fabric surface.

During the knitting in this modification, at a predetermined place of the warp knitted fabric, the knit structure of any one of the jacquard bars JB2, JB3, JB4, and JB5 becomes the knit structure in (a) of FIG. 8, and the knit structure of the remaining three jacquard bars becomes the knit structure in (b) of FIG. 8. Then, only the jacquard yarn in the knit structure in (a) of FIG. 8 appears on the surface of the frontside base fabric and the surface of the backside base fabric, and the other jacquard yarns do not appear on the surface of the backside base fabric. Then, different jacquard bars JB2, JB3, JB4, and JB5 are selected for respective places of the warp knitted fabric.

In the warp knitting machine illustrated in FIG. 2, in each of the jacquard bars JB2, JB3, JB4, and JB5, only one jacquard guide is disposed for two knitting needles. Thus, when a knit structure (e.g., the knit structure in (a) of FIG. 4) is knitted such that any one jacquard bar overlaps with knitting needles of the backside knitting needle row BN, by one stitch, no jacquard yarn appears in a stitch adjacent to the stitch where a jacquard yarn appears, on the backside base fabric.

However, according to this modification, since the jacquard yarn forms stitches over two wales in one course, the jacquard yarn also appears in a stitch adjacent to the stitch where the jacquard yarn appears, on the backside base fabric, and furthermore, jacquard yarns appear in all stitches on the backside base fabric. Thus, the color of the backside base fabric becomes darker, and the jacquard pattern becomes brighter.

As the modification of the knit structure in (a) of FIG. 8, there is also a knit structure in which the jacquard bar does not overlap with the knitting needles of the frontside knitting needle row FN. In the case of this knit structure, in the jacquard yarn, a portion between stitches is inserted into the frontside base fabric.

<Modification 3>

Figure 9:
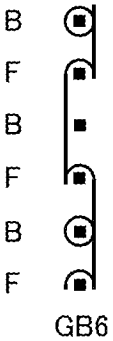
FIG. 9 is a modification of a structure diagram of a guide bar GB6.

FIG. 9 illustrates a modification of the knit structure of the ground guide bar GB6. As can be seen from FIG. 9, the knit structure of the ground guide bar GB6 is a knit structure in which stitches are formed in all courses in the frontside base fabric, and stitches are formed in every other course in the backside base fabric. The knit structure of FIG. 9 is represented by 1-0-0-1/0-1-1-1// as chain numbers.

When the yarn of the ground guide bar GB6 is knitted into the frontside base fabric and the backside base fabric in this manner, the frontside base fabric and the backside base fabric are connected and an intermediate layer between the frontside base fabric and the backside base fabric is stabilized. Further, the jacquard yarn is pressed against the frontside base fabric.

<Modification 4>

Figure 10:
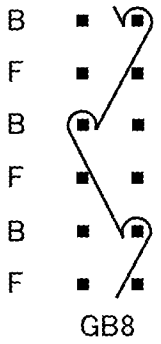
FIG. 10 is a modification of a structure diagram of a guide bar GB8.
Figure 11:
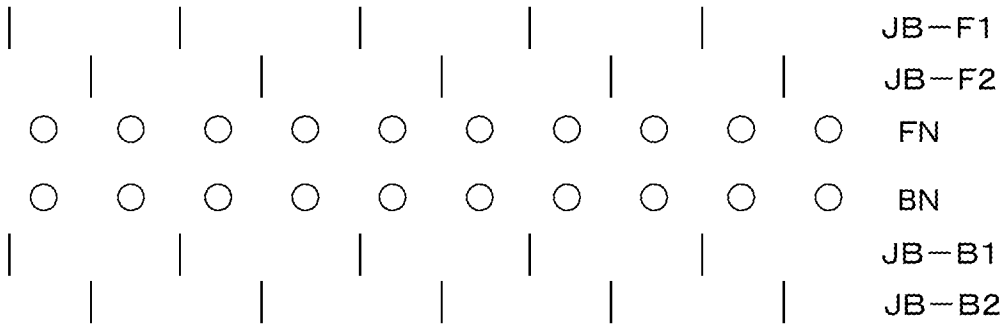
FIG. 11 is a view illustrating the arrangement of knitting needles and guides when a conventionally known double raschel warp knitting machine is viewed from above.

FIG. 10 illustrates a modification of the knit structure of the ground guide bar GB8. The knit structure of the ground guide bar GB8 in this modification is a knit structure in which stitches are formed on the backside base fabric like in the above embodiment. However, in the knit structure of the ground guide bar GB8 in the above embodiment, a yarn is knitted over three wales (that is, the yarn reciprocates between three needles in the wale direction (weft direction) in one repeating unit of the knit structure) whereas in the knit structure of the ground guide bar GB8 in this modification, a yarn is knitted over only two wales (that is, the yarn reciprocates between two needles in the wale direction (weft direction) in one repeating unit of the knit structure).

The knit structure of FIG. 10 is represented by 1-1-0-1/1-1-2-1// as chain numbers. The yarn is knitted over only two wales in this manner, and the swing width in the wale direction (weft direction) is small, so that the backside base fabric becomes thin.

<Modification 5>

The warp knitted fabric is used as a material of clothing, interiors, and accessories as well as a shoe upper.

REFERENCE SIGNS LIST

FN . . . Frontside knitting needle row
BN . . . Backside knitting needle row
JB2, JB3 . . . Front jacquard bar
JB4, JB5 . . . Back jacquard bar
GB1, GB6, GB7, GB8 . . . Ground guide bar
10 . . . Warp knitted fabric
11 . . . Upper portion
12 . . . Peripheral portion
21 . . . First portion
22 . . . Second portion
23 . . . Third portion
24 . . . Fourth portion

The invention claimed is:

1. A method of knitting a double raschel warp knitted fabric with a double raschel warp knitting machine, the double raschel warp knitting machine comprising: a frontside knitting needle row and a backside knitting needle row as a plurality of knitting needle rows; a pair of frontside jacquard bars and a pair of backside jacquard bars as jacquard bars in which jacquard guides are arranged, the jacquard guides of the pair of frontside jacquard bars and the pair of backside jacquard bars forming four jacquard bars, wherein the four jacquard bars are arranged in rows in a front-rear direction of the knitting machine, in which each of the frontside jacquard bars and the backside jacquard bars is a half-gauge jacquard bar; and at least one frontside ground guide bar provided on a front side of the frontside jacquard bars and at least one backside ground guide bar provided on a back side of the backside jacquard bars, as ground guide bars in which guides are arranged, wherein in the double raschel warp knitting machine, the half-gauge jacquard bars of each of the frontside jacquard bars and the backside jacquard bars form four half-gauge jacquard bars, wherein the four half-gauge jacquard bars have the jacquard guides at the same positions in a width direction of the knitting machine, the method comprising:

supplying different colors of yarns to the four half-gauge jacquard bars, respectively, knitting a frontside base fabric by the at least one frontside ground guide bar, knitting a backside base fabric by the at least one backside ground guide bar, wherein at a predetermined place, at least four places are present, and the half-gauge jacquard bars are selected for the predetermined places, respectively, wherein one of the four half-gauge jacquard bars is selected, and the selected half-gauge jacquard bar knits a knit structure where a yarn extends over two or more wales of the backside base fabric and forms stitches on the backside base fabric, and at the same predetermined place, each of unselected three of the half-gauge jacquard bars knits a knit structure where a different yarn is inserted into the frontside base fabric.

2. The double raschel warp knitted fabric knitting method according to claim 1, wherein the yarn from the knit structure formed from the selected half-gauge jacquard bar further forms stitches on the frontside base fabric and the backside base fabric.

3. The double raschel warp knitted fabric knitting method according to claim 1, wherein the yarn from the knit structure formed from the selected half-gauge jacquard bar further forms stitches on only the backside base fabric, and a portion of the yarn is between stitches inserted into the frontside base fabric.

4. The double raschel warp knitted fabric knitting method according to claim 1, wherein the yarn from the knit structure formed from the selected half-gauge jacquard bar overlaps with the backside base fabric by two needles.

5. The double raschel warp knitted fabric knitting method according to claim 1, wherein the at least one backside ground guide bar is provided in the double raschel warp knitting machine, and stitches are formed on the frontside base fabric by the at least one backside ground guide bar.

* * * * *